US005138834A

United States Patent [19]

Maund et al.

[11] Patent Number: 5,138,834

[45] Date of Patent: Aug. 18, 1992

[54] EXHAUST SYSTEM FOR V-CONFIGURED INTERNAL COMBUSTION ENGINE WITH CLOSE-MOUNTED CATALYTIC CONVERTER

[75] Inventors: Ehren R. Maund, Greensburg, Pa.; Egas J. De Sousa, Grand Blanc, Mich.

[73] Assignee: General Motors Corporation, Detroit, Mich.

[21] Appl. No.: 678,509

[22] Filed: Apr. 1, 1991

[51] Int. Cl.[5] ..... F01N 3/28

[52] U.S. Cl. ..... 60/276; 60/299; 60/302; 422/176; 422/180

[58] Field of Search ..... 60/276, 277, 299, 302, 60/323; 422/180, 176

[56] References Cited

U.S. PATENT DOCUMENTS

| | | | |
|---|---|---|---|
| 1,793,813 | 2/1931 | MacKinnon | 60/302 |
| 3,927,525 | 12/1975 | Jacobs | 60/301 |
| 3,994,130 | 11/1976 | Sakai | 60/302 |
| 4,019,883 | 4/1977 | Klomp | 55/264 |
| 4,689,951 | 9/1987 | Polach | 60/275 |
| 4,693,078 | 9/1987 | Dettling et al. | 60/295 |
| 4,833,882 | 5/1989 | Yasuda | 60/276 |

FOREIGN PATENT DOCUMENTS

| | | | |
|---|---|---|---|
| 1012076 | 12/1965 | United Kingdom | 422/173 |
| 2047338 | 11/1980 | United Kingdom | 60/276 |

*Primary Examiner*—Douglas Hart
*Attorney, Agent, or Firm*—Karl F. Barr, Jr.

[57] ABSTRACT

An exhaust system for a v-configured, internal combustion engine having a close-coupled, catalytic converter having a converter assembly located adjacent the engine comprising a pre-chamber upstream of the catalyst support which has inlet assemblies oriented, and a cross-section configured to induce a centrifugal swirling action in the exhaust gas as it passes therethrough. The swirling action of the exhaust gas inhibits reversion of particles, trapped upstream of the converter, into the engine.

3 Claims, 2 Drawing Sheets

EXHAUST SYSTEM FOR V-CONFIGURED INTERNAL COMBUSTION ENGINE WITH CLOSE-MOUNTED CATALYTIC CONVERTER

BACKGROUND OF THE INVENTION

1. Field of the Invention

The present invention relates to an exhaust system for use with a v-configured internal combustion engine having a close-mounted catalytic converter as an aid to early converter light-off and, more particularly, to an exhaust system having a pre-chamber adjacent to the converter which acts to prevent reversion of particles into the engine.

2. Description of the Relevant Art

Typical automotive exhaust systems incorporate catalytic converters which operate to reduce the level of harmful emissions generated by the vehicle's internal combustion engine. A standard practice is to locate the converter in an under-floor configuration in a manner similar to most vehicle mufflers. The under-floor location is convenient from a space utilization aspect, however, the remote mounting encourages heat loss from the exhaust gas during its transit from the engine to the converter. Such heat loss affects the efficiency of the converter in that it increases the time to light-off, which is the temperature the converter must reach before it begins to effectively reduce exhaust emissions.

One method of reducing converter light-off time is to "close-couple" the converter to the engine. In effect, the converter is placed as close as possible to the exhaust ports of the engine, thereby reducing the distance the gas must travel after leaving the engine and minimizing the heat loss therefrom. On v-configured engines, this method generally requires the use of one catalytic converter mounted adjacent each exhaust bank with the outlets joined further downstream of the engine. This configuration is inefficient from the standpoint of cost and complexity since it requires the use of an additional converter which represents a substantial cost penalty. Additionally, the close proximity of the converters to the exhaust ports of the engine require special precautions to be taken, especially in the case of ceramic converter monoliths, to prevent particles generated by the converter from being drawn into the engine.

SUMMARY OF THE INVENTION

In accordance with the present invention, an exhaust system for use with a v-configured engine with a close-mounted catalytic converter is disclosed. The system comprises a pre-chamber preferably located adjacent one end of the engine and connected to the respective exhaust banks by substantially equal length exhaust conduits. The conduits deliver exhaust gas from the engine to inlets in the pre-chamber which are oriented to induce a centrifugal swirling of the gas as it passes therethrough. The gas is subject to mixing and a reduction in velocity which allows for more efficient catalyst usage by presenting a more homogeneous mixture of gasses and by eliminating the center effect which has been observed in many converters and tends to under-utilize the catalyst towards the outside of the monolith. Additionally, the swirling gas forces particle strapped upstream of the converter from moving further upstream where they may be drawn into the engine.

The outlet of the pre-chamber is configured to be coupled with the inlet of a catalytic converter, in effect, acting as the inlet cone for the converter. The outlet of the converter delivers treated gas to the remainder of the exhaust system which conducts the gas to a point of discharge.

The present invention provides a cost effective exhaust system configuration for use on a v-configured engine which utilizes a single, close-mounted catalytic converter. The system incorporates a pre-chamber which utilizes the velocity of the entering exhaust gas to induce a centrifugal force which inhibits the reversion of particles into the engine.

Other objects and features of the invention will become apparent by reference to the following description and to the drawings.

DESCRIPTION OF THE PREFERRED EMBODIMENT

Figure 1:
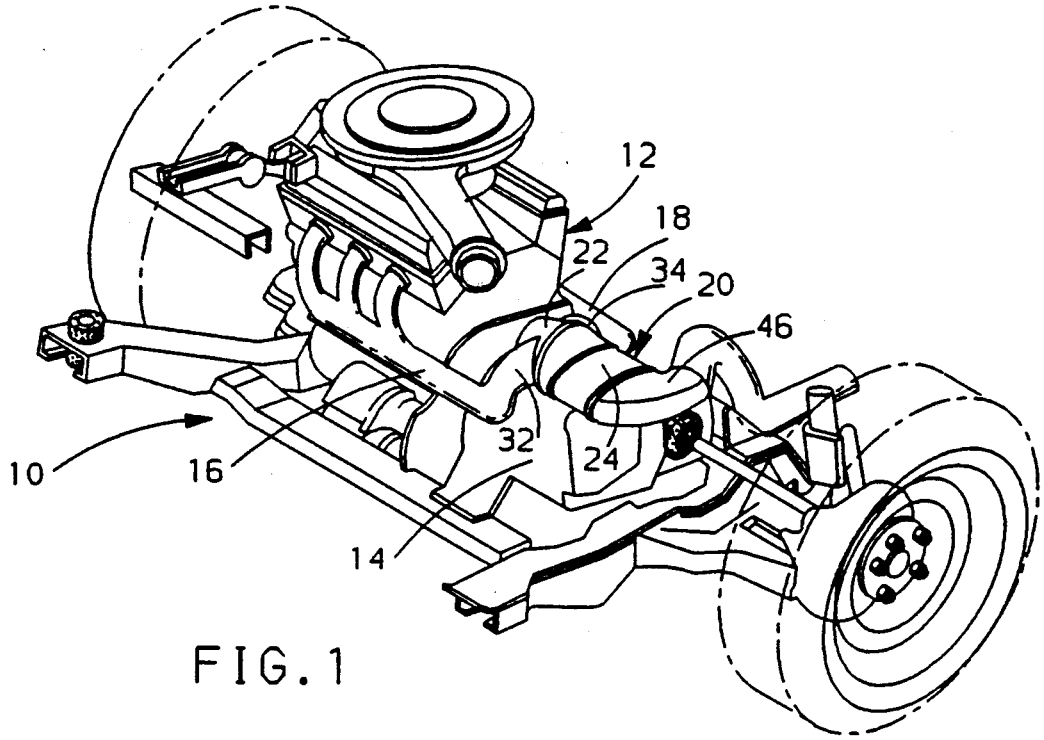
FIG. 1 is a schematic view of a portion of a motor vehicle engine compartment embodying the present invention.

In FIG. 1 there is shown a schematic view of a portion of the engine compartment of an automobile 10 embodying the present invention. A v-configured internal combustion engine 12 is shown coupled to transmission 14 and the assembly is mounted within the automobile in a transverse manner.

Exhaust transfer conduits 16 and 18 connect adjacent exhaust ports of their respective engine banks and conduct exhaust gas emitted form engine 12 to a location adjacent one end of the engine. The transfer conduits 16,18 may be of unitary construction embodying the exhaust manifold as shown, or may comprise a manifold and separate transfer pipe. Additionally, the conduits 16,18 should preferably be configured so that the exhaust paths are substantially the same length.

Located at the terminus of exhaust transfer conduits 16,18 is catalytic converter assembly 20. As shown in detail in FIGS. 2, 3, and 4, the converter assembly 20 comprises a pre-chamber 22 and an adjacently mounted catalytic converter 24. The pre-chamber has a first closed end 26, a central mixing chamber 28, and a second, opened end 30. Side mounted inlet assemblies 32 and 34 extend outwardly from the perimeter of pre-chamber 22 form a location which is adjacent the first, closed end 26 and couple with exhaust transfer conduits 16,18 respectively to conduct exhaust gas into the chamber 22. As may be best seen in FIG. 3, pre-chamber 22 has a cross-section which is conducive to rotational gas flow as indicated by arrows 35, and inlets 32 and 34 are configured, with respect to the cross-section, to introduce exhaust gas into the chamber in such a manner as to induce a centrifugal, swirling effect therein.

Catalytic converter 24 comprises a catalyst support 36 disposed within a rigid outer shell 38. The catalyst support 36 may be constructed of extruded ceramic, stacked metal foil sheets, or any other suitable material and is coated with a catalyst material in a manner well known in the art. In the embodiment shown in FIG. 2, a flexible support wrap 40 is disposed between the rigid outer shell 38 and catalyst support 36 to protect the support from damage due to vibration and stress caused by thermal expansion differentials between shell 38 and the catalyst support 36.

The upstream or inlet end 42 of converter 24 is configured to be sealingly coupled to the second, opened end 30 of pre-chamber 22. In effect, the pre-chamber 22 acts as an inlet cone for the catalytic converter. The downstream or outlet end 44 of the converter is coupled to exhaust conduit 46 which is part of the downstream portion of the exhaust system. Exhaust conduit 46 and its associated downstream components will vary with specific application.

In operation, exhaust gas emitted from internal combustion engine 12 is transferred, through exhaust transfer conduits 16, 18 to pre-chamber 22 where the gas enters the chamber adjacent the first, closed end 26 through side mounted inlets 32,34. The configuration of the inlets 32, 34 and the pre-chamber cross-section induce a centrifugal swirling effect in the gas as it moves axially through the mixing chamber 28. The centrifugal action act to inhibit particles trapped upstream of the converter 24 from being drawn into engine 12 during periods of exhaust pressure decrease such as deceleration.

As the gases move towards the catalytic converter 24, the velocity profile is changed so that a more even velocity profile at the entry of the converter is produced, which differs from many standard converters with velocity profiles which vary substantially across the face of the support unit. Additionally, the swirling action of the gas in chamber 28 produces a more homogeneous mixture of gas constituents thereby enhancing catalyst efficiency.

Subsequently, the exhaust gas exits pre-chamber 22 and enters catalytic converter 24 and subsequently to the atmosphere.

Figure 2:
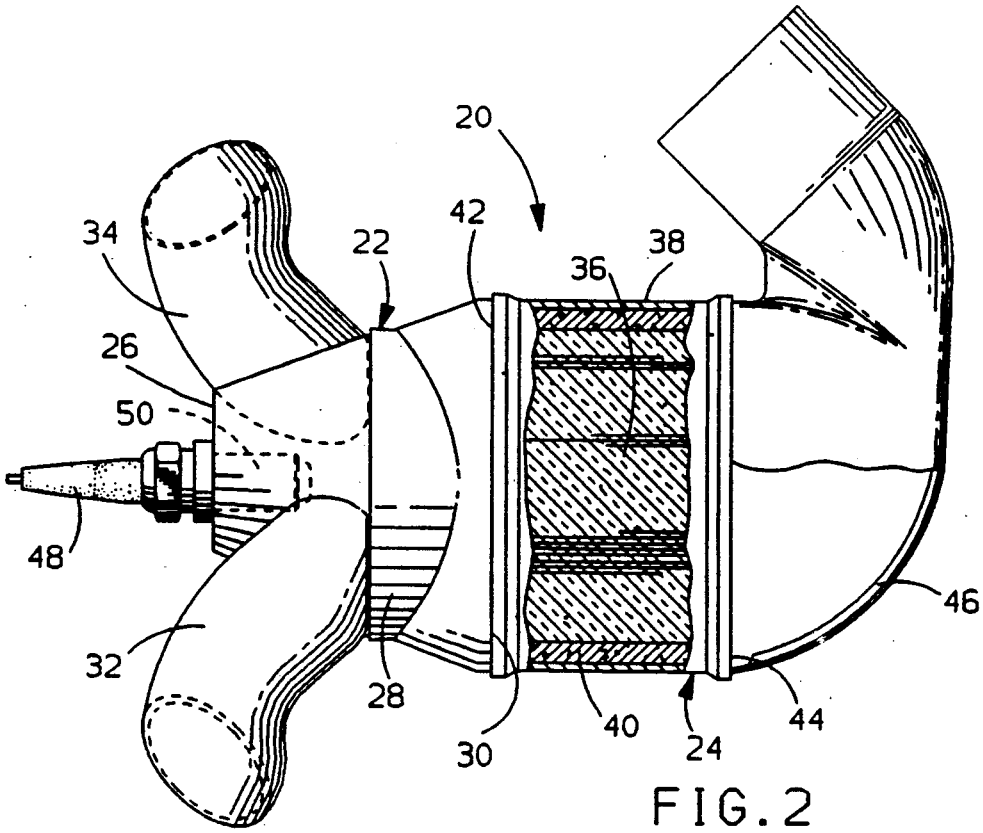
FIG. 2 is a plan view, partially in section, of a catalytic converter assembly embodying the present invention.
Figure 3:
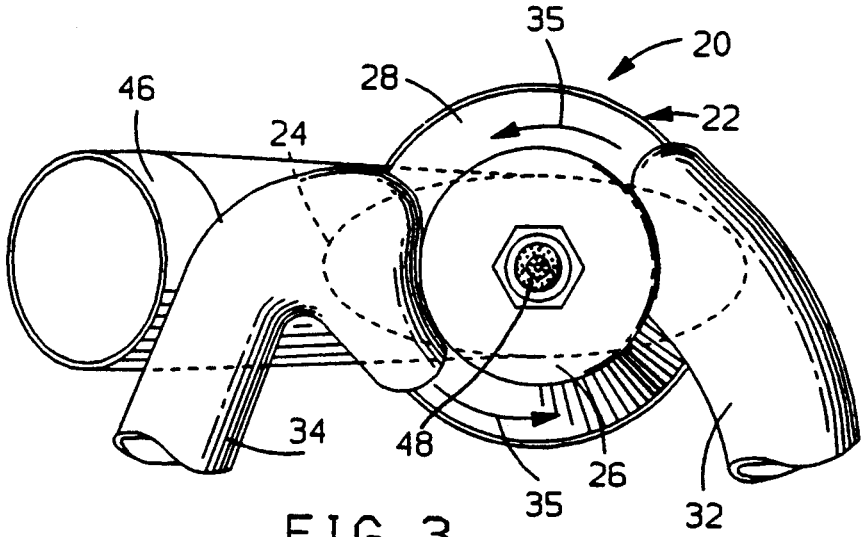
FIG. 3 is an end view of the catalytic converter assembly of FIG. 2.
Figure 4:
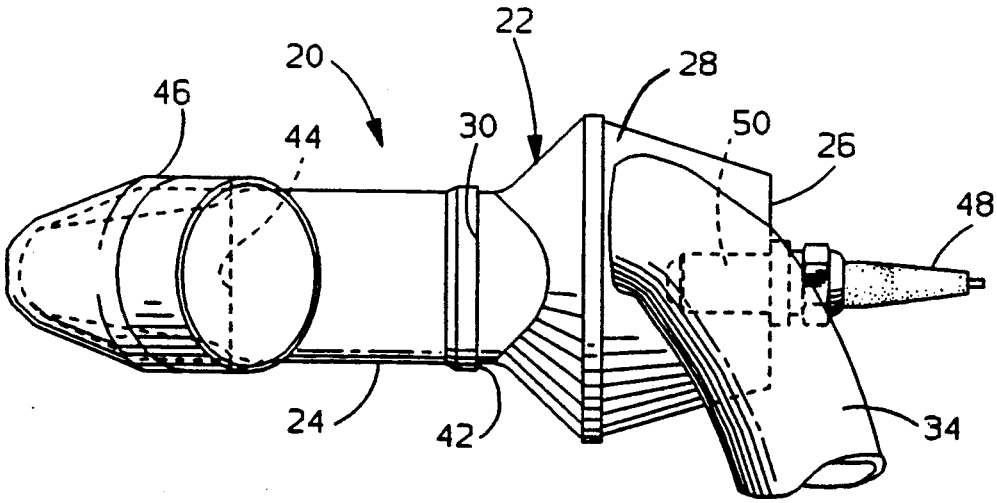
FIG. 4 is a side view of the catalytic converter assembly of FIG. 2.

As shown in FIGS. 2 and 3, the exhaust system configuration of the present invention is well suited to the sue of a single oxygen sensor 48. Placement of the sensor 48 at the first, closed end 26 of pre-chamber 22 allows the sensor to sample gas entering the chamber from both banks of the engine. The use of an extended boss 50 places the sensor well into the mixing chamber.

In order to minimize under-hood temperature increases which are the result of converter placement within the engine compartment, various insulating measures may be employed such as the application of dual walled exhaust conduits 46. The particular insulating needs will vary with vehicle application.

Also ,the converter assembly of the present invention may be used in conjucntion with secondary, under-floor converters which have a longer light-off period but, due to lesser space restraint, may be larger and therefore capable of increased exhaust treatment.

Although the preferred embodiment of the present invention incorporates the converter assembly 20 into the exhaust system of a v-configured internal combustion engine, it should not be limited to such an application. The converter assembly may be applied to single exhaust source such as are produced in an in-line engine or in cases where it is desirable to utilize a separate close-mounted catalytic converter for each bank of a v-configured engine.

While certain embodiments of the invention have been described in detail above in relation to an exhaust system for a v-configured internal combustion engine with a close-coupled catalytic converter, it would be apparent to those skilled in the art that the disclosed embodiment may be modified. Therefore, the foregoing description is to be considered exemplary, rather than limiting, and the true scope of the invention is that describe in the following claims.

The embodiments of the invention in which an exclusive property or privilege is claimed are defined as follows:

1. An exhaust system for a v-configured, internal combustion engine having a close-coupled, catalytic converter comprising:

a pre-chamber having a first, closed end and a second, opened end spaced axially therefrom by a centrally placed mixing section, first and second inlet means extending from the sides of said pre-chamber adjacent said first, closed end, said inlets oriented and said pre-chamber having a cross-section configured to induce a centrifugal swirling effect in exhaust gas entering said pre-chamber through said inlet means; and a catalytic converter having an inlet end configured to be sealingly coupled to said second, opened end of said pre-chamber and having an outlet end for emitting exhaust gas therefrom.

2. An exhaust system for an internal combustion engine having a close-coupled, catalytic converter as defined in claim 1, further comprising:

first and second exhaust conduits connecting the adjacent exhaust ports of each respective bank of the engine with said first and second inlet means, respectively;

said first and second exhaust conduits having substantially equal lengths.

3. An exhaust system for an internal combustion engine having a close-coupled, catalytic converter as defined in claim 1, further comprising:

sensor mounting means in said first, closed end of said pre-chamber and oriented to sample exhaust gas from said first and second inlet means.

* * * * *